US007077684B2

(12) United States Patent
Sasame et al.

(10) Patent No.: US 7,077,684 B2
(45) Date of Patent: Jul. 18, 2006

(54) CABLE CONNECTOR

(75) Inventors: Naotaka Sasame, Saitama (JP); Junya Tsuji, Tokyo (JP); Shuji Kajinuma, Kanagawa (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 10/933,870

(22) Filed: Sep. 3, 2004

(65) Prior Publication Data

US 2005/0054232 A1 Mar. 10, 2005

(30) Foreign Application Priority Data

Sep. 4, 2003 (JP) ..... 2003-312409

(51) Int. Cl.
*H01R 13/627* (2006.01)

(52) U.S. Cl. ..... 439/350; 439/358

(58) Field of Classification Search ..... 439/729, 439/90–91, 909, 86, 822, 490–491, 350–358
See application file for complete search history.

(56) References Cited

U.S. PATENT DOCUMENTS 5,533,908 A 7/1996 Henry et al.
5,749,746 A * 5/1998 Tan et al. ..... 439/357
5,766,027 A 6/1998 Fogg
5,797,771 A 8/1998 Garside
6,165,006 A * 12/2000 Yeh et al. ..... 439/490
6,305,959 B1 10/2001 Baker et al.
6,431,901 B1 * 8/2002 Yeh ..... 439/357
6,558,183 B1 5/2003 Ji et al.
6,623,312 B1 * 9/2003 Merry et al. ..... 439/729

* cited by examiner

*Primary Examiner*—P. Austin Bradley
*Assistant Examiner*—Edwin A. Leon
(74) *Attorney, Agent, or Firm*—Barley Snyder, LLC

(57) ABSTRACT

The present invention provides a cable connector that can reduce the stress that is generated in the solder connections between the contacts of the connector and the circuit board. The cable connector comprises a plurality of contacts, each having a contact part configured to contact a mating contact on one end, and a soldering part on the other end, a circuit board that is soldered to the soldering part of the contacts and is soldered to a cable, a housing that accommodates the contacts, the housing having a mating part disposed on the front thereof configured to mate with the mating connector and circuit board supporting parts that support the circuit board and extend rearward from both ends of the mating part, and locking arms disposed in the housing and configured to lock with a mating connector. The locking arms extend along both sides of the mating part and extend along the circuit board supporting parts.

6 Claims, 11 Drawing Sheets

PRIOR ART

CABLE CONNECTOR

FIELD OF THE INVENTION

The present invention relates to a cable connector used in electrical or electronic devices such as portable telephones and digital cameras.

BACKGROUND OF THE INVENTION

An exemplary cable connector 101, shown in FIGS. 11A to 11C, is known (see U.S. Pat. No. 5,766,027). As is shown in FIG. 11A, this cable connector 101 comprises a plurality of contacts 110, a housing 120 that accommodates the plurality of contacts 110, a circuit board 130 that is soldered to the respective contacts 110 and soldered to a conductor 161 of a cable 160. A metal shell 140 covers the housing 120. Each contact 110 has a contact part 111 that contacts a mating contact on one end (the end on the side that mates with the mating connector), and has a soldering part 112 that is soldered to the circuit board 130 on the other end.

Moreover, as is shown in FIGS. 11A, 11B and 11C, the housing 120 comprises a mating part 121 disposed on the front side (i.e., on the left side in FIGS. 11A and 11B) that mates with a mating connector, and circuit board supporting parts 122 that extend rearward from both ends of the mating part 121. Circuit board receiving grooves 125 are formed in the circuit board supporting parts 122. Contact receiving channels 123 are formed in the mating part 121 in a single row, and a latching arm 124 is formed which extends at an inclination to the rear from the upper surface of the mating part 121.

This cable connector 101 is completed as follows: specifically, after the circuit board 130 is supported by the circuit board supporting parts 122, the soldering parts 112 of the respective contacts 110 and the conductor 161 of the cable 160 are soldered to the circuit board 130; then, an insulating overmolding member 170 is overmolded around the cable 160 and the metal shell 140 that covers the housing 120. In FIG. 11A, the symbol 171 indicates a strain relief.

However, problems have been encountered in this conventional cable connector 101. Specifically, the anti-twisting strength following the overmolding of the overmolding member 170, i.e., the mechanical strength of the parts that support the circuit board 130 when the cable connector 101 is twisted in the vertical direction indicated by the arrow in FIG. 11A, is low. Accordingly, if the cable connector 101 is pulled out of the mating connector while being twisted in the vertical direction, a large stress is applied to the solder connection parts between the circuit board 130 and the soldering parts 112 of the contacts 110, so that the electrical connections between the contacts 110 and the circuit board 130 cannot always be ensured.

SUMMARY OF THE INVENTION

To solve these and other problems, an exemplary embodiment of the present invention provides a cable connector which comprises contacts, a housing that accommodates these contacts, and a circuit board that is connected by soldering to the contacts and connected by soldering to the cable, and in which the contacts each have a contact part that contacts a mating contact on one end, and a soldering part that is attached by soldering to the circuit board on the other end, and the housing has a mating part that mates with a mating connector disposed on the front, and circuit board supporting parts that are used to support the circuit board and that extend rearward from both ends of the mating part, wherein locking arms that are locked with the mating connector, and that extend along both sides of the mating part and extend along the circuit board supporting parts, are disposed in the housing, and these locking arms have soldering parts that are attached by soldering to the circuit board.

DETAILED DESCRIPTION OF THE INVENTION

Figure 1A:
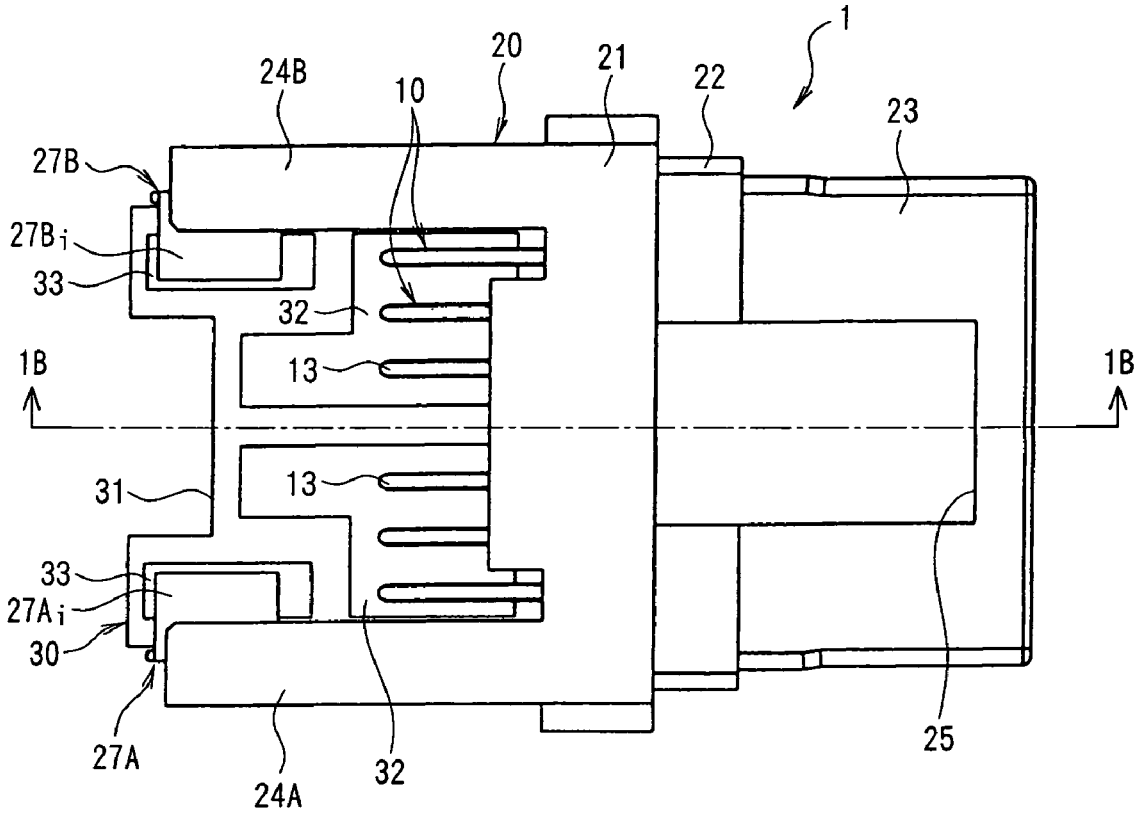
FIGS. 1A and 1B show the cable connector of the present invention, with FIG. 1A being a plan view, and FIG. 1B being a sectional view along line 1B—1B in FIG. 1A.

Next, an embodiment of the present invention will be described with reference to the figures. In FIGS. 1A and 1B, and 2A to 2C, the cable connector 1 comprises a plurality of contacts 10, a housing 20 that accommodates the contacts 10, a circuit board 30 that is soldered to the contacts 10 and soldered to a cable 40 (see FIGS. 8A and 8B), and a pair of left and right locking arms 27A and 27B that are locked to the mating connector (not shown in the figures). This cable connector 1 may be used, for example, in the direct-current power supply of a digital camera.

As shown in FIGS. 1A and 1B, and 3A and 3B, each contact 10 comprises a fastening part 11 that is press-fitted to the housing 20, a contact part 12 that extends forward (i.e., to the right in FIG. 1B) from the fastening part 11 and contacts a mating contact (not shown in the figures), and a soldering part 13 that extends rearward from the fastening part 11 and is soldered to the circuit board 30. The respective contacts 10 may be formed, for example, by stamping and forming a metal plate.

As is shown in FIGS. 3A and 3B, and 4A to 4C, the housing 20 accommodates the plurality of contacts 10 in two rows (upper and lower rows), and comprises a substantially rectangular base part 21, a mating part 23 that extends forward from the base part 21 via a step part 22 and that mates with a mating connector (not shown in the figures), and a pair of left and right circuit board supporting parts 24A and 24B that extend rearward from either end of the base part 21 and that are used to support the circuit board 30. The housing 20 may be formed, for example, by molding an insulating resin. The mating part 23 has a substantially rectangular shape. The contacts 10 disposed in two rows (upper and lower rows) are accommodated in the housing 20 so that the fastening part 11 of each contact 10 is press-fitted to the base part 21 from the rear of the housing 20, and so that the contacts of the upper and lower rows face each other. Furthermore, the contact part 12 of each contact 10 is positioned inside the mating part 23, and the soldering part 13 is positioned between the circuit board supporting parts 24A and 24B. The gap between the soldering parts 13 of the upper and lower rows is a gap that allows the insertion and clamping of the circuit board 30. Moreover, an anchoring step part 25 is formed on the upper surface of the mating part 23 to anchor a projection formed on the mating connector when the mating connector is mated with the mating part 23. In addition, locking arm accommodating grooves 26 that extend in the forward-rearward direction along the left and right side surfaces of the mating part 23 are formed in both side surfaces of the mating part 23. Thus, the mating part comprises the mating part 23, the step part 22, and the base part 21.

As shown in FIGS. 3A and 3B, and 4A to 4C, locking arm receiving recesses 24Aa and 24Ba are formed in the respective inside surfaces of the circuit board supporting parts 24A and 24B of the housing 20. The locking arm receiving recesses 24Aa and 24Ba, that receive the respective supporting plates 27Af and 27Bf and soldering parts 27Ag and 27Bg of the left and right locking arms 27A and 27B (described in detail later). Each of the locking arm receiving recesses 24Aa and 24Ba extends in the forward-rearward direction from the rear end portion of the corresponding circuit board supporting part 24A or 24B to the base part 21. Furthermore, locking arm fastening through-holes (not shown in the figures) that communicate with the locking arm receiving recesses 24Aa and 24Ba are formed so that these through-holes pass through the base part 21 of the housing 20 in the forward-rearward direction.

Figure 5A:
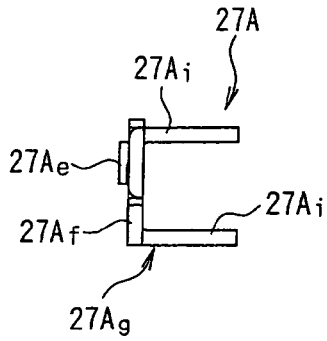
FIGS. 5A and 5B shows the left locking arm disposed on the left side of the housing of the cable connector of FIGS. 1A and 1B, with FIG. 5A being a front view, and FIG. 5B being a left side view.
Figure 5B:
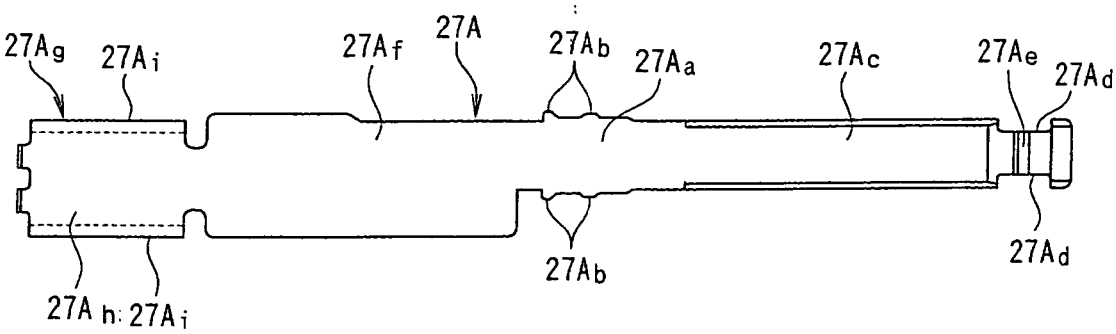

Of the pair of left and right locking arms 27A and 27B, the left locking arm 27A is mounted on the left side (lower side in FIG. 3A and left side in FIG. 4A) of the housing 20. As is shown in FIGS. 5A and 5B, the left locking arm 27A comprises a fastening plate 27Aa which has a plurality of anchoring projections 27Ab above and below, an extension plate 27Ac that extends forward from the fastening plate 27Aa, and an anchoring protrusion 27Ae which is disposed on the front end of the extension plate 27Ac, and whose width is narrowed by upper and lower cut-outs 27Ad. Furthermore, the left locking arm 27A further comprises a supporting plate 27Af that extends rearward from the fastening plate 27Aa with a greater width than the fastening plate 27Aa, and a soldering part 27Ag that extends rearward from the supporting plate 27Af. The left locking arm 27A may be formed, for example, by stamping and forming a metal plate. The fastening plate 27Aa of the left locking arm 27A is press-fitted in the locking arm fastening through-hole (formed in the base part 21) from the rear of the housing 20. As a result, the extension plate 27Ac and anchoring protrusion 27Ae are positioned in the locking arm receiving groove 26 along the left side of the mating part 23, and the supporting plate 27Af and soldering part 27Ag are positioned in the locking arm receiving recess 24Aa along the inside surface of the circuit board supporting part 24A. Furthermore, the anchoring protrusion 27Ae is disposed so that this part is locked on an anchoring projection (not shown in the figures) disposed on the mating connector when the cable connector is mated with the mating connector. Moreover, the supporting plate 27Af is disposed so that it contacts the left side of the circuit board 30 and restricts the leftward movement of the circuit board 30. Furthermore, the soldering part 27Ag is formed with a cross-sectional reverse C shape consisting of a regulating plate 27Ah that contacts the left side of the circuit board 30 and restricts the leftward movement of the circuit board 30, and a pair of soldering pieces 27Ai that are bent inward (to the right) from the upper and lower edges of the regulating plate 27Ah, and that are soldered to the upper and lower surfaces of the circuit board 30. This reverse C shape of the soldering part 27Ag envelops the left side of the circuit board 30.

Figure 6A:
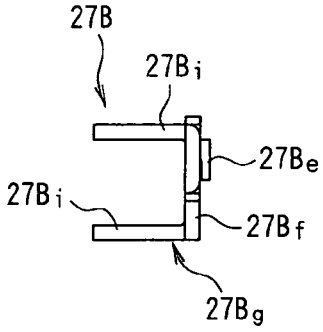
FIGS. 6A to 6C show the right locking arm disposed on the right side of the housing of the cable connector of FIGS. 1A and 1B, with FIG. 6A being a front view, FIG. 6B being a right side view, and FIG. 6C being a plan view.
Figure 6B:
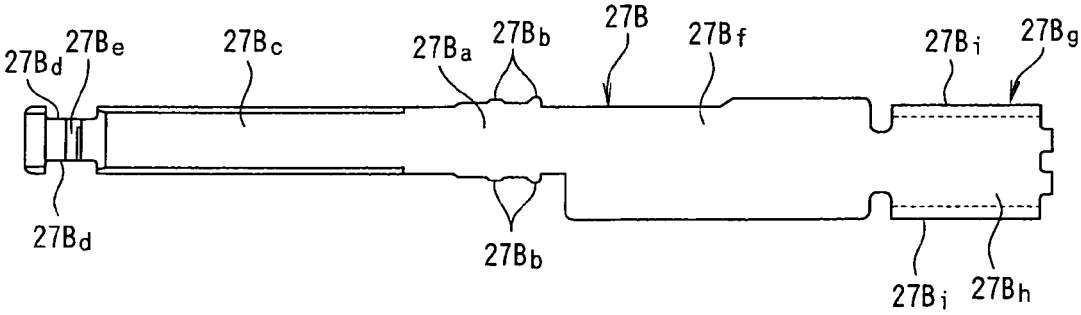
Figure 6C:
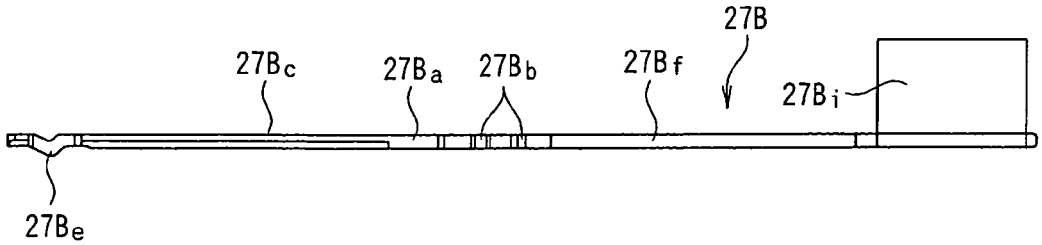

Meanwhile, the right locking arm 27B is mounted on the right side (upper side in FIG. 3A and right side in FIG. 4A) of the housing 20, and has a shape that shows mirror symmetry with the left locking arm 27A. Specifically, as is shown in FIGS. 6A to 6C, the right locking arm 27B comprises a fastening plate 27Ba which has a plurality of anchoring projections 27Bb above and below, an extension plate 27Bc that extends forward from the fastening plate 27Ba, and an anchoring protrusion 27Be which is disposed on the front end of the extension plate 27Bc, and whose width is narrowed by upper and lower cut-outs 27Bd. Furthermore, the right locking arm 27B further comprises a supporting plate 27Bf that extends rearward from the fastening plate 27Ba with a greater width than the fastening plate 27Ba, and a soldering part 27Bg that extends rearward from the supporting plate 27Bf. The right locking arm 27B may be formed, for example, by stamping and forming a metal plate. The fastening plate 27Ba of the right locking arm 27B is press-fitted in the locking arm fastening through-hole (formed in the base part 21) from the rear of the housing 20. As a result, the extension plate 27Bc and anchoring protrusion 27Be are positioned in the locking arm receiving groove 26 along the right side part of the mating part 23, and the supporting plate 27Bf and soldering part 27Bg are positioned in the locking arm receiving recess 24Ba along the inside surface of the circuit board supporting part 24B. Furthermore, the anchoring protrusion 27Be is disposed so that this part is locked on an anchoring projection (not shown in the figures) disposed on the mating connector when the cable connector is mated with the mating connector. Moreover, the supporting plate 27Bf is disposed so that it contacts the right side of the circuit board 30 and restricts the rightward movement of the circuit board 30. Furthermore, the soldering part 27Bg is formed with a cross-sectional reverse C shape consisting of a regulating plate 27Bh that contacts the right side of the circuit board 30 and restricts the rightward movement of the circuit board 30, and a pair of soldering pieces 27Bi that are bent inward (to the left) from the upper and lower edges of the regulating plate 27Bh, and that are soldered to the upper and lower surfaces of the circuit board 30. This reverse C shape of the soldering part 27Bg envelops the right side of the circuit board 30.

Figure 7A:
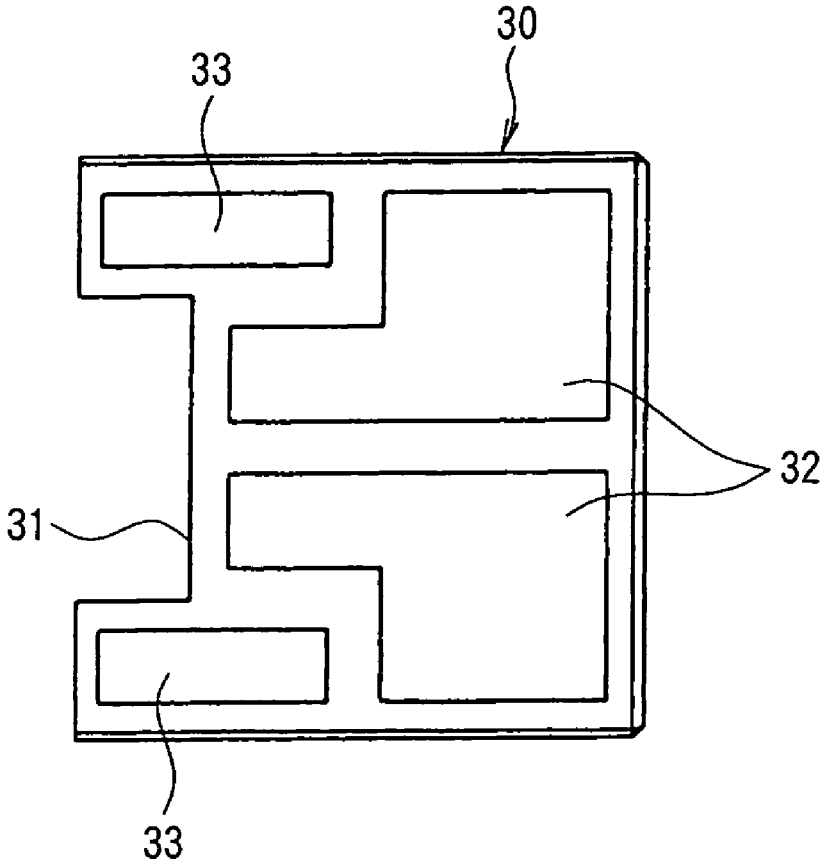
FIGS. 7A and 7B show the circuit board of the cable connector of FIGS. 1A and 1B, with FIG. 7A being a plan view, and FIG. 7B being a left side view.
Figure 7B:
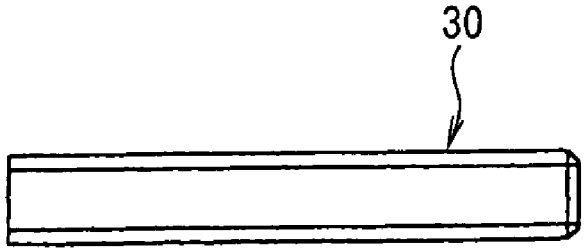

As is shown clearly in FIGS. 7A and 7B, the circuit board 30 is a rectangular flat plate in which a cut-out 31 is formed in the center of the rear end (left end in FIGS. 7A and 7B). A plurality of conductive pads 32 are formed on the front of the upper and lower surfaces (only the conductive pads 32 on the upper surface are shown in the figures), and fastening pads 33 are formed on the upper and lower surfaces on both sides of the cut-out 31. The soldering parts 13 of the contacts 10 in the upper row and the electrical wires 41 of the cable 40 are soldered to the conductive pads 32 on the upper surface, and the soldering parts 27Ag and 27Bg of the left and right locking arms 27A and 27B are soldered to the fastening pads 33. Furthermore, the soldering parts 13 of the contacts 10 in the lower row are soldered to the conductive pads 32 on the lower surface.

Figure 8A:
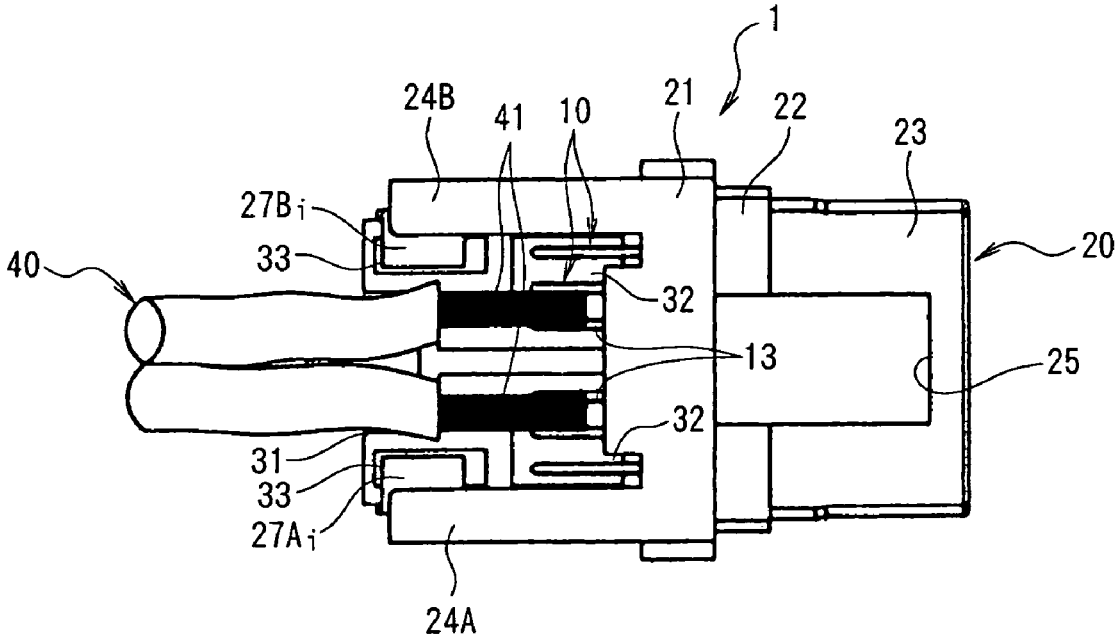
FIGS. 8A and 8B show the cable connector shown in FIGS. 1A to 1C in a state in which the cable is connected by soldering to the circuit board, with FIG. 8A being a plan view, and FIG. 8B being a left-side sectional view.
Figure 8B:
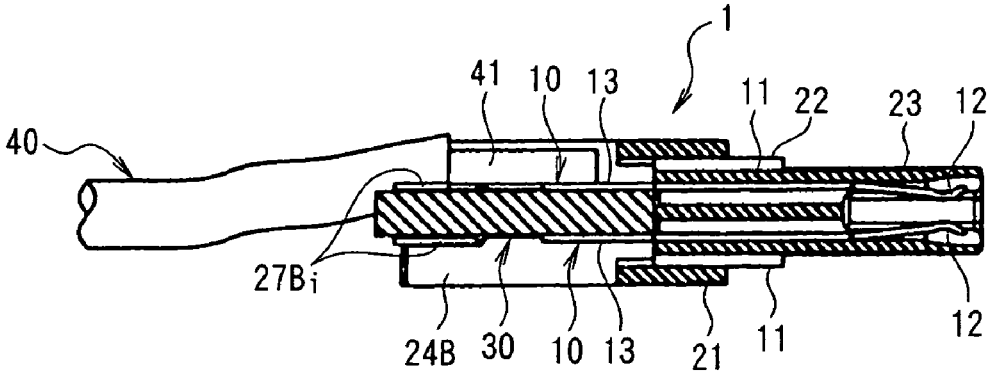
Figure 9A:
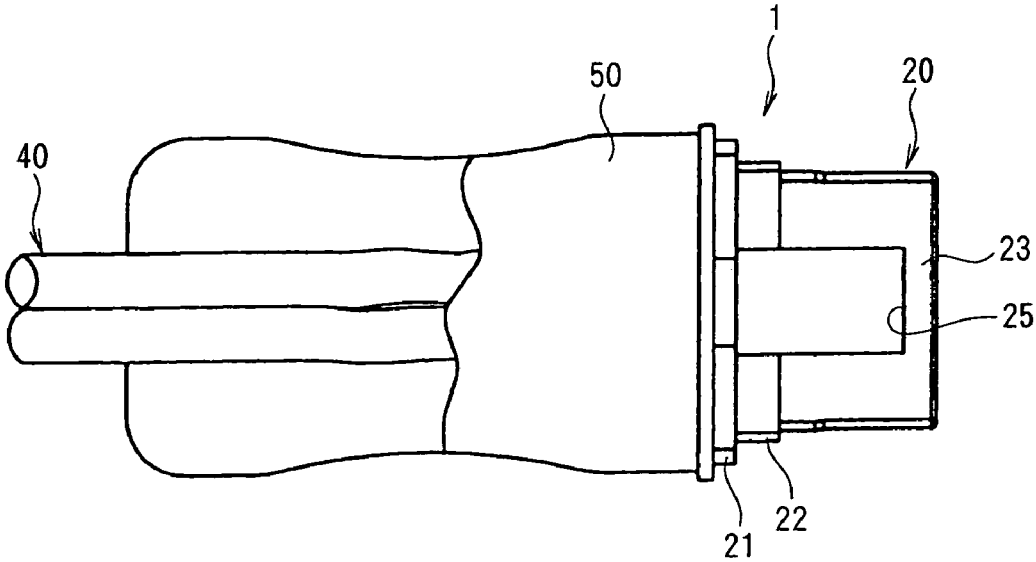
FIGS. 9A and 9B show the cable connector of FIGS. 8A and 8B in a state in which inner molding is performed from the state shown in FIGS. 8A and 8B, with FIG. 9A being a plan view showing a portion of the inner molding member cut away, and FIG. 9B being a left-side sectional view.
Figure 9B:
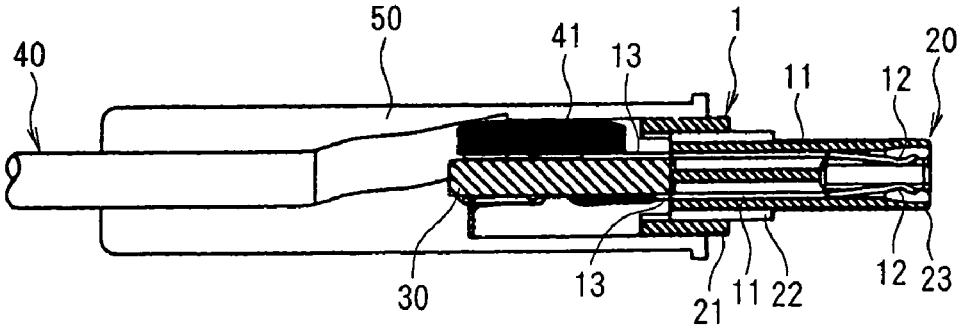
Figure 10A:
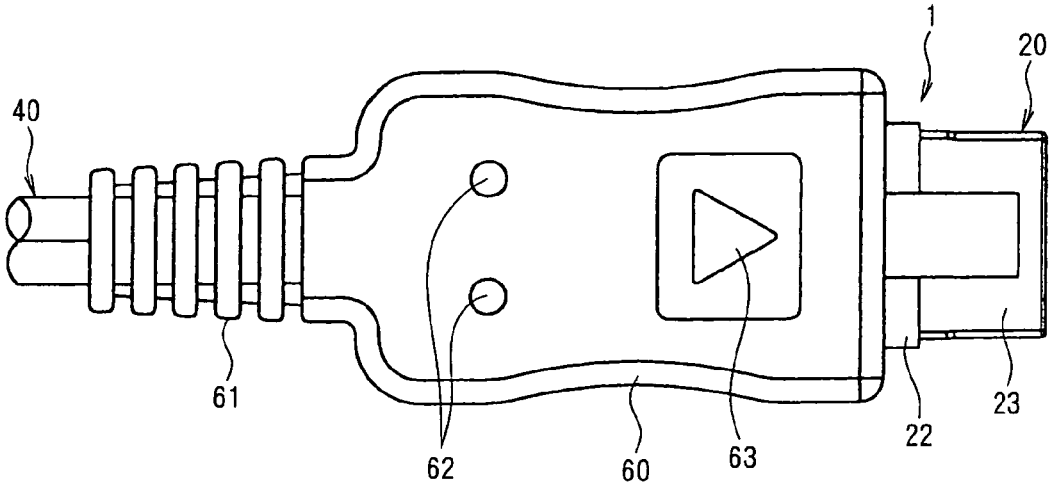
FIGS. 10A and 10B show the completed unit of the cable connector in which overmolding has been performed from the state in which inner molding was performed as shown in FIGS. 9A and 9B, with FIG. 10A being a plan view, and FIG. 10B being a left side view.
Figure 10B:
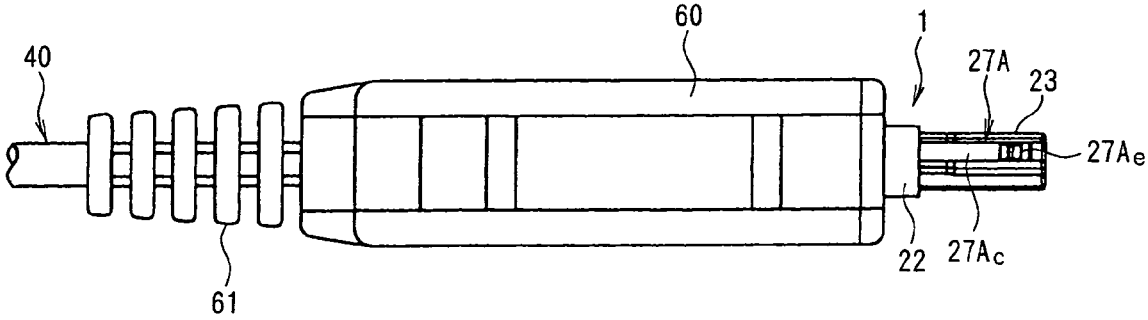
Figure 11A:
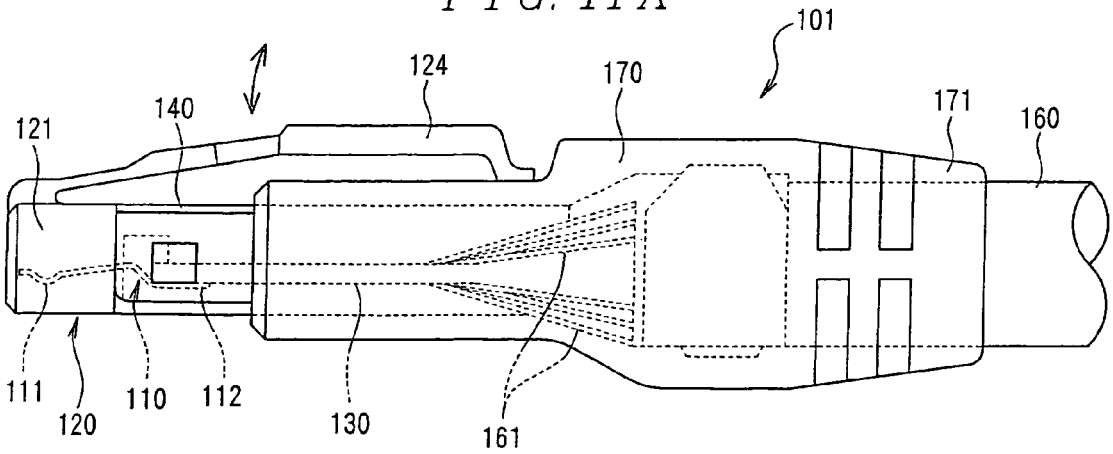
PRIOR ART FIG. 11A
FIGS. 11A to 11C show a conventional example of a cable connector, with FIG. 11A being a side view, FIG. 11B being a bottom view of the housing used in the cable connector, and FIG. 11C being a back view of the housing used in the cable connector.
Figure 11B:
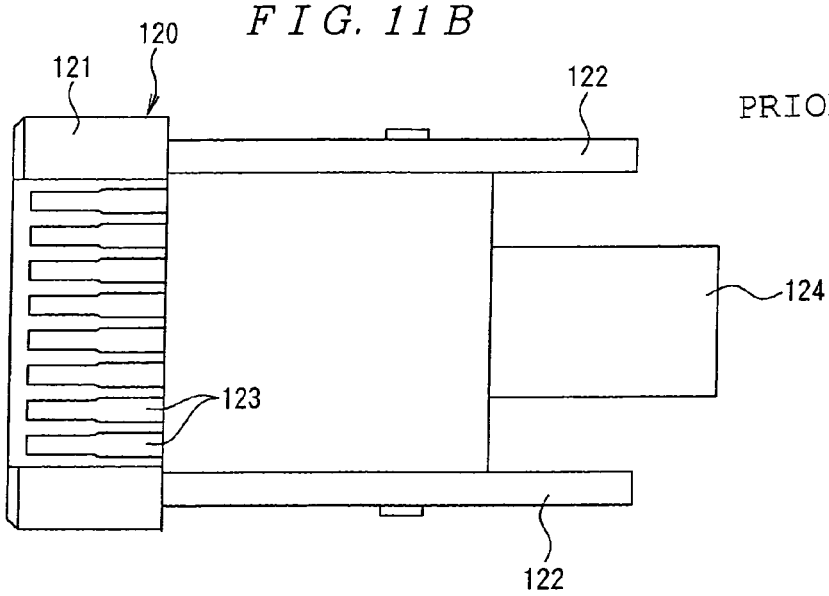
Figure 11C:
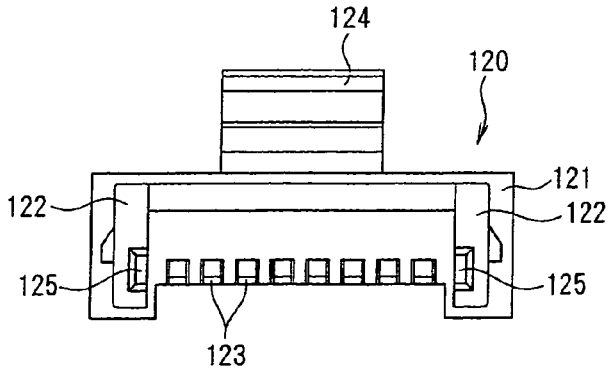
PRIOR ART FIG. 11C

Next, the assembly method of the cable connector 1 will be described with reference to FIGS. 1A and 1B, 2A to 2C, 3A, and 3B, 4A to 4C, 5A, and 5B, 6A to 6C, 7A and 7B, 8A and 8B, 9A and 9B, and 10A and 10B. FIGS. 8A and 8B show the cable 40 soldered to the circuit board 30 of the cable connector 1 shown in FIGS. 1A and 1B, with FIG. 8A being a plan view, and FIG. 8B being a left-side sectional view. FIGS. 9A and 9B show the cable connector from FIGS. 8A and 8B in a state in which inner molding is performed, with FIG. 9A being a plan view showing a portion of the inner molding member cut away, and FIG. 9B being a left-side sectional view. FIGS. 10A and 10B show the completed unit in which overmolding has been performed, with FIG. 10A being a plan view, and FIG. 10B being a left side view.

Figure 1B:
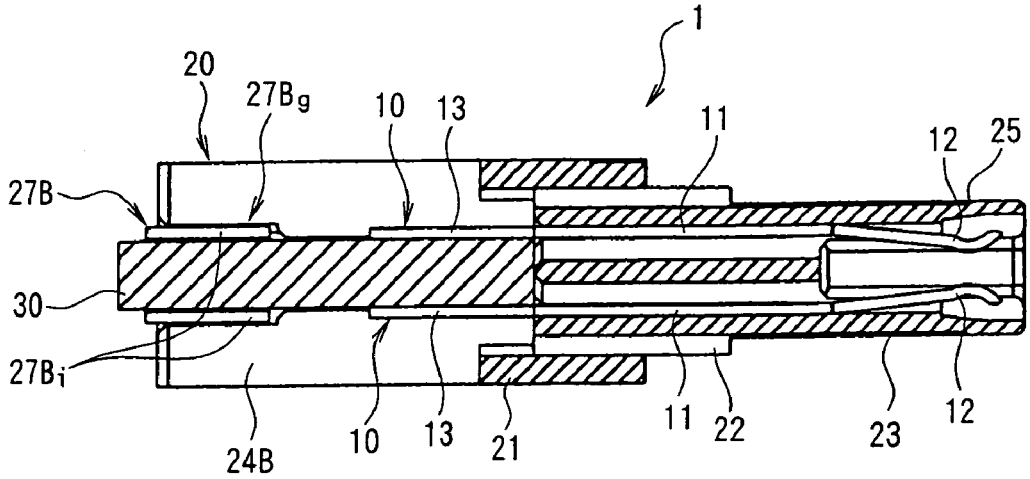
Figure 2A:
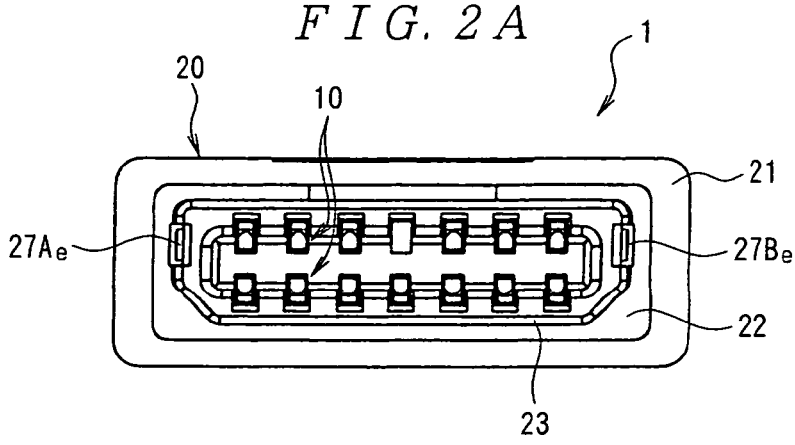
FIGS. 2A to 2C show the cable connector in FIGS. 1A and 1B, with FIG. 2A being a front view, FIG. 2B being a left side view, and FIG. 2C being a back view.
Figure 2B:
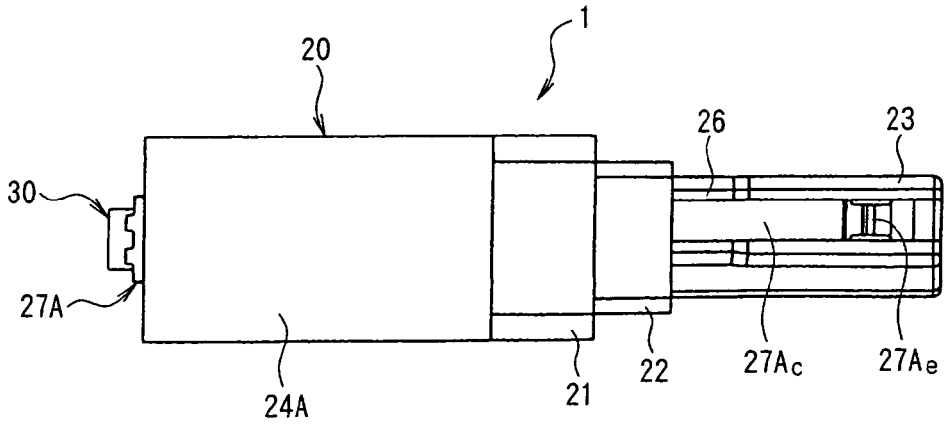
Figure 2C:
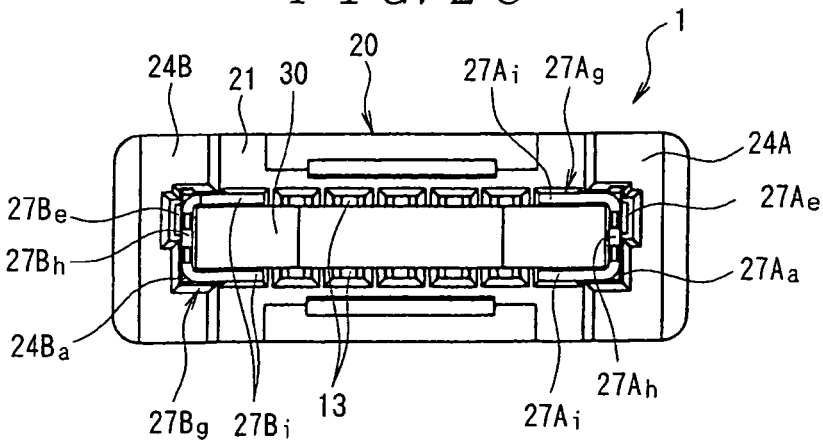
Figure 3A:
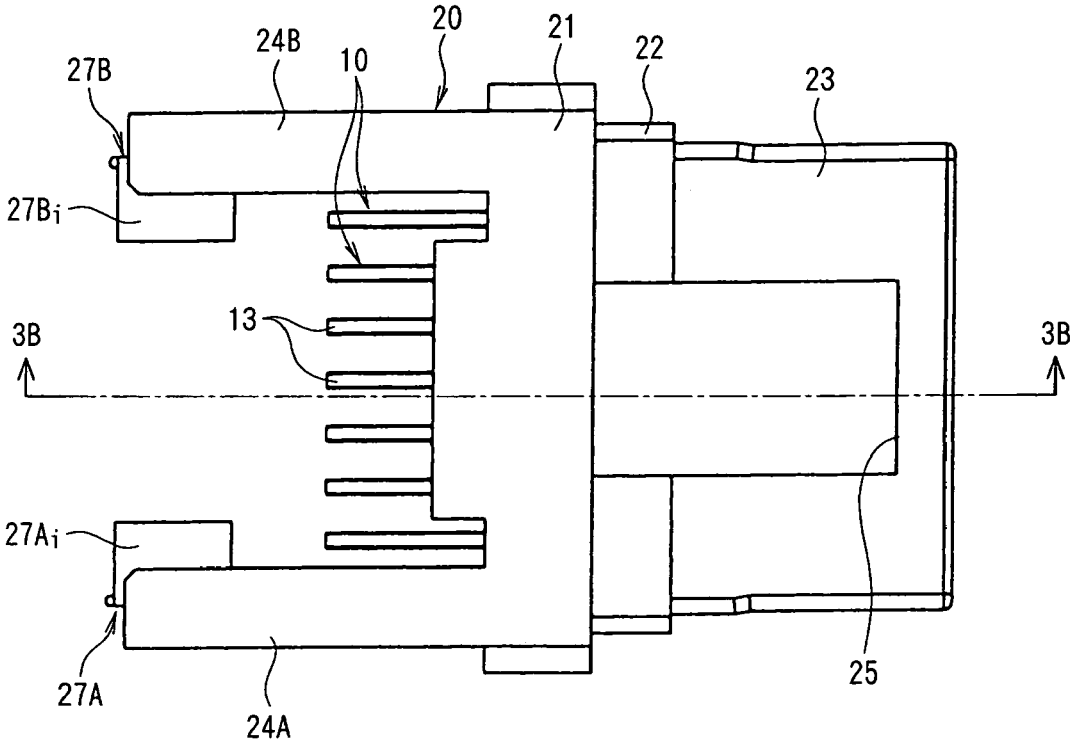
FIGS. 3A and 3B show the cable connector of FIGS. 1A and 1B in a state in which the circuit board is removed from the cable connector, with FIG. 3A being a plan view, and FIG. 3B being a sectional view along line 3B—3B in FIG. 3A.
Figure 3B:
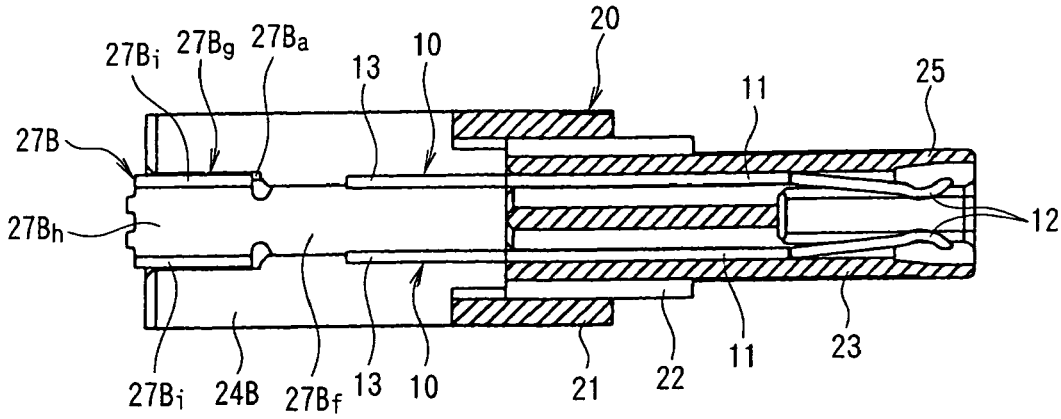
Figure 4A:
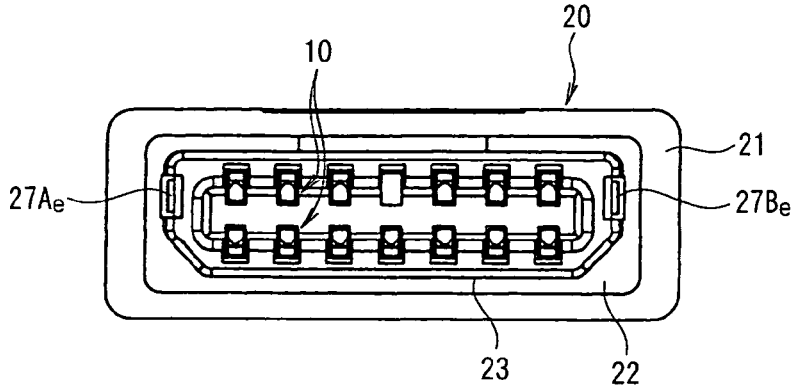
FIGS. 4A to 4C show the cable connector of FIGS. 3A and 3B, in a state in which the circuit board is removed from the cable connector, with FIG. 4A being a front view, FIG. 4B being a left side view, and FIG. 4C being a back view.
Figure 4B:
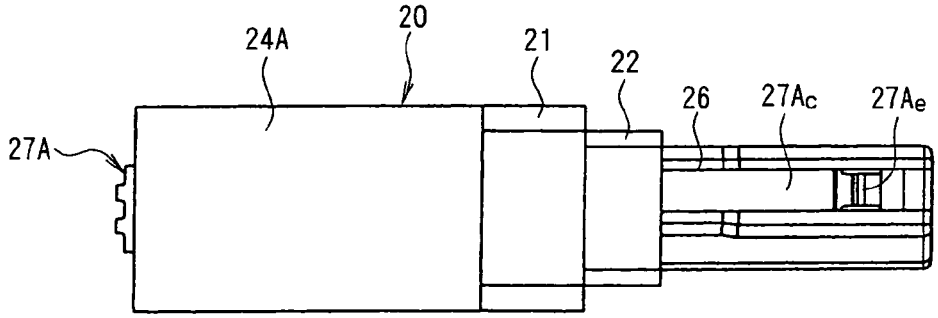
Figure 4C:
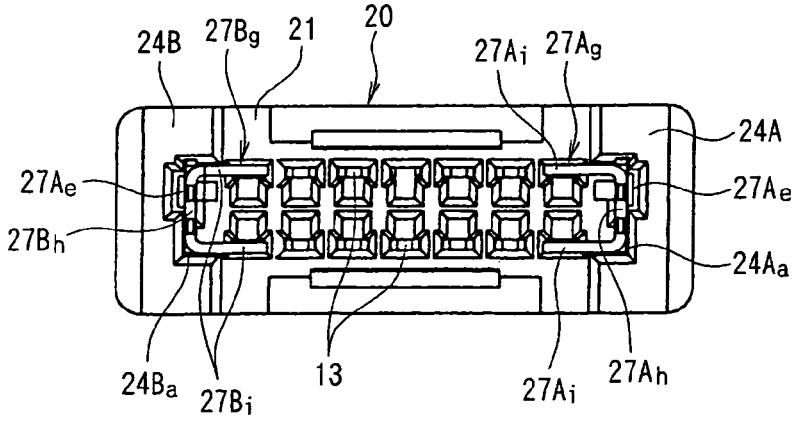

In the assembly of the cable connector 1, the plurality of contacts 10 and the left and right locking arms 27A and 27B are first attached to the housing 20 in specified positions as shown in FIGS. 3A and 3B. Then, the circuit board 30 is inserted between the circuit board supporting parts 24A and 24B of the housing 20 from the rear of the housing 20 as shown in FIGS. 1A and 1B. In this case, the front end of the circuit board 30 is positioned between the soldering parts 13 of the contacts 10 of the upper and lower rows, and both sides at the rear of the circuit board 30 are enveloped by the regulating plates 27Ah and 27Bh and upper and lower soldering pieces 27Ai and 27Bi that constitute the soldering parts 27Ag and 27Bg of the left and right locking arms 27A and 27B. In this case, the forward movement of the circuit board 30 is restricted as a result of the front end surface of the circuit board 30 contacting the base part 21 of the housing 20. Furthermore, the leftward movement of the circuit board 30 is restricted as a result of the left side of the circuit board 30 contacting the supporting plate 27Af and regulating plate 27Ah of the left locking arm 27A, and the rightward movement of the circuit board 30 is restricted as a result of the right side of the circuit board 30 contacting the supporting plate 27Bf and regulating plate 27Bh of the right locking arm 27B. Moreover, the movement of the circuit board 30 in the upward and downward directions is restricted as a result of the front end of the circuit board 30 being positioned between the soldering parts 13 of the contacts 10 of the upper and lower rows, and both sides at the rear of the circuit board 30 being enveloped by the upper and lower soldering pieces 27Ai and 27Bi of the soldering parts 27Ag and 27Bg.

Then, the soldering parts 13 of the contacts 10 of the upper and lower rows are connected by soldering them to the conductive pads 32 on the upper and lower surfaces of the circuit board 30, and the upper and lower soldering pieces 27Ai and 27Bi of the soldering parts 27Ag and 27Bg of the left and right locking arms 27A and 27B are connected by soldering them to the fastening pads 33 of the circuit board 30.

Next, the electrical wires 41 of the cable 40 are connected by soldering them to the conductive pads 32 on the upper surface of the circuit board 30 as shown in FIGS. 8A and 8B. In this case, the cable 40 extends rearward via the cut-out 31 formed in the circuit board 30.

Subsequently, as is shown in FIGS. 9A and 9B, inner molding is performed primarily by an inner molding member 50 around the circuit board supporting parts 24A and 24B of the housing 20, the circuit board 30, the cable 40, and the like. As a result, the solder connections between the contacts 10 and the circuit board 30 and the solder connections between the cable 40 and the circuit board 30 are protected.

Finally, as shown in FIGS. 10A and 10B, overmolding is performed by means of an overmolding member 60 around the inner molding member 50 and around a portion of the cable 40. As a result, a strain relief 61 is formed around the cable 40, and the cable connector 1 is completed. In FIGS. 10A and 10B, the symbol 62 indicates holes formed by round pins used to support the inner molding during overmolding. Furthermore, the symbol 63 indicates a triangular marking used to cause agreement of the front and back (top and bottom) with the mated mating connector.

The cable connector 1 thus completed is mated with the mating connector by the mating part 23. As a result, the contacts 10 and the mating contacts are electrically connected, so that the electrical connection of the mating connector and cable 40 is accomplished. Meanwhile, if the cable connector 1 is pulled out of the mating connector, the electrical connection between the mating connector and cable 40 is released.

In the exemplary embodiment illustrated ands described above, the soldering parts 27Ag and 27Bg of the locking arms 27A and 27B are connected by soldering to the fastening pads 33 of the circuit board 30, so that the circuit board 30 is fastened to the locking arms 27A and 27B. Accordingly, the anti-twisting strength of the cable connector 1 following the overmolding of the overmolding member 60, i.e., the mechanical strength of the parts that support the circuit board 30 when the cable connector 1 is twisted in the vertical direction, is increased. Consequently, even if the cable connector 1 is pulled out of the mating connector while being twisted in the vertical direction, the stress that is generated in the solder connections between the circuit board 30 and the soldering parts 13 of the contacts 10 is reduced, providing more reliable electrical connections between the contacts 10 and circuit board 30.

Furthermore, since the soldering parts 27Ag and 27Bg of the locking arms 27A and 27B are formed with a cross-sectional reverse C shape, and have a structure that envelops the sides of the circuit board, the mechanical strength with which the circuit board 30 is supported is reinforced, so that the stress that is generated in the solder connections between the circuit board 30 and the soldering parts 13 of the contacts 10 can be reduced.

An embodiment of the present invention was described above. However, the present invention is not limited to this embodiment; various alterations or modifications can be made.

For example, the circuit board supporting parts 24A and 24B may extend directly rearward from both ends of the mating part 23 rather than from both ends of the base part 21.

In addition, as long as the soldering parts 27Ag and 27Bg of the locking arms 27A and 27B have a structure that allows for soldering to the circuit board 30, these parts need not necessarily have a reverse C shape in cross section.

What is claimed is:

1. A cable connector comprising:

a plurality of contacts, each having contact part configured to contact a mating contact on one end, and a soldering part on the other end;

a circuit board that is soldered to the soldering part of the contacts and is soldered to a cable;

a housing that accommodates the contacts; the housing having a mating part disposed on the front thereof configured to mate with the mating connector and circuit board supporting parts that support the circuit board and extend rearward from both ends of the mating part;

locking arms disposed in the housing, extending along both sides of the mating part and along the circuit board supporting parts and being configured to lock with a mating connector; the locking arms having soldering parts that are soldered to the circuit board, a fastening plate with a plurality of anchoring projections above and below, an extension plate that extends forward from the fastening plate, a supporting plate extending from the fastening plate and an anchoring protrusion which is disposed on the front end of the extension plate; and the soldering part extending rearward from the supporting plate and being soldered to the circuit board, the soldering part being formed with a cross-sectional reverse C shape consisting of a regulating plate that contacts the side of the circuit board and restricts the sideway movement of the circuit board and a pair of soldering pieces that are bent inward from the upper and lower edges of the regulating plate and that are soldered to the upper and lower surfaces of the circuit board.

2. The cable connector according to claim 1, wherein the soldering parts of the locking arms have a structure that is formed in a reverse C shape in cross section, and that envelops the sides of the circuit board.

3. The cable connector according to claim 1, wherein the anchoring protrusion has a width that is narrowed by upper and lower cut-outs.

4. The cable connector according to claim 1, wherein a locking arm fastening through-hole is formed in the base part and the fastening plate is press-fitted in the locking arm fastening through-hole from the rear of the housing.

5. The cable connector according to claim 1, wherein the supporting plate extends rearward from the fastening plate wit a greater width than the fastening plate.

6. The cable connector according to claim 5 wherein the supporting plate is disposed so that it contacts the side of the circuit board and restricts the sideway movement of the circuit board.

* * * * *

UNITED STATES PATENT AND TRADEMARK OFFICE

CERTIFICATE OF CORRECTION

PATENT NO. : 7,077,684 B2
APPLICATION NO. : 10/933870
DATED : July 18, 2006
INVENTOR(S) : Naotaka Sasame et al.

It is certified that error appears in the above-identified patent and that said Letters Patent is hereby corrected as shown below:

In column 8, line 27 delete “wit” and insert --with--

Signed and Sealed this

Third Day of October, 2006

JON W. DUDAS
*Director of the United States Patent and Trademark Office*